US008038084B2

(12) United States Patent
Dilly et al.

(10) Patent No.: US 8,038,084 B2
(45) Date of Patent: Oct. 18, 2011

(54) ROLLER MILL

(75) Inventors: Dirk Dilly, Beckum (DE); Franz-Josef Zurhove, Bad Iburg (DE); Thomas Rüther, Drensteinfurt (DE); Ludwig Könning, Ahlen (DE); Pedro Guerrero Palma, Luppetal (DE); Bernhard Peterwerth, Bad Laer (DE); Thomas Spliethoff, Oelde (DE); Heiko Fornefeld, Hamm (DE)

(73) Assignee: Polysius AG, Beckum (DE)

( * ) Notice: Subject to any disclaimer, the term of this patent is extended or adjusted under 35 U.S.C. 154(b) by 197 days.

(21) Appl. No.: 12/528,479

(22) PCT Filed: Feb. 25, 2009

(86) PCT No.: PCT/EP2008/052262

§ 371 (c)(1),
(2), (4) Date: Aug. 25, 2009

(87) PCT Pub. No.: WO2008/104521

PCT Pub. Date: Sep. 4, 2008

(65) Prior Publication Data

US 2010/0252667 A1 Oct. 7, 2010

(30) Foreign Application Priority Data

Feb. 28, 2007 (DE) ..... 10 2007 009 723

(51) Int. Cl.

| | |
|---|---|
| ***B02C 4/32*** | (2006.01) |
| ***B02C 7/14*** | (2006.01) |
| ***B02C 9/04*** | (2006.01) |
| ***B02C 11/08*** | (2006.01) |

(52) U.S. Cl. ..... 241/37; 241/121

(58) Field of Classification Search ..... 241/37, 241/121

See application file for complete search history.

(56) References Cited

U.S. PATENT DOCUMENTS

| | | | | | |
|---|---|---|---|---|---|
| 4,235,385 | A | * | 11/1980 | Brundiek | 241/110 |
| 4,432,500 | A | * | 2/1984 | Brundiek et al. | 241/57 |
| 6,021,968 | A | * | 2/2000 | Brundiek et al. | 241/121 |
| 2005/0023390 | A1 | | 2/2005 | Burynski et al. | |

FOREIGN PATENT DOCUMENTS

| | | | |
|---|---|---|---|
| DE | 509212 | C | 10/1930 |
| GB | 943450 | A | 12/1963 |

* cited by examiner

*Primary Examiner* — Bena Miller

(74) *Attorney, Agent, or Firm* — Gifford, Krass, Sprinkle, Anderson & Citlowski, P.C.

(57) ABSTRACT

The invention relates to a roller mill having a mill housing, a mill path which is supported so as to be rotatable about a mill axis inside the mill housing, and at least one mill roller which can be rotated about a mill roller shaft and which is engaged with the mill path in terms of rolling action. There is further provided a pivot lever which is for rotatably retaining the mill roller and which has a pivot shaft arranged parallel with the mill roller axis and which is supported outside the mill housing. The pivot lever is further in operational contact with a hydropneumatic resilient system in order to adjust the pressing pressure of the mill roller. The pivot lever is supported outside the mill housing with spacing therefrom in such a manner that the forces which are produced by the hydropneumatic resilient system are dissipated into the mill foundation directly or via pillars.

14 Claims, 13 Drawing Sheets

ROLLER MILL

Figure 1A:
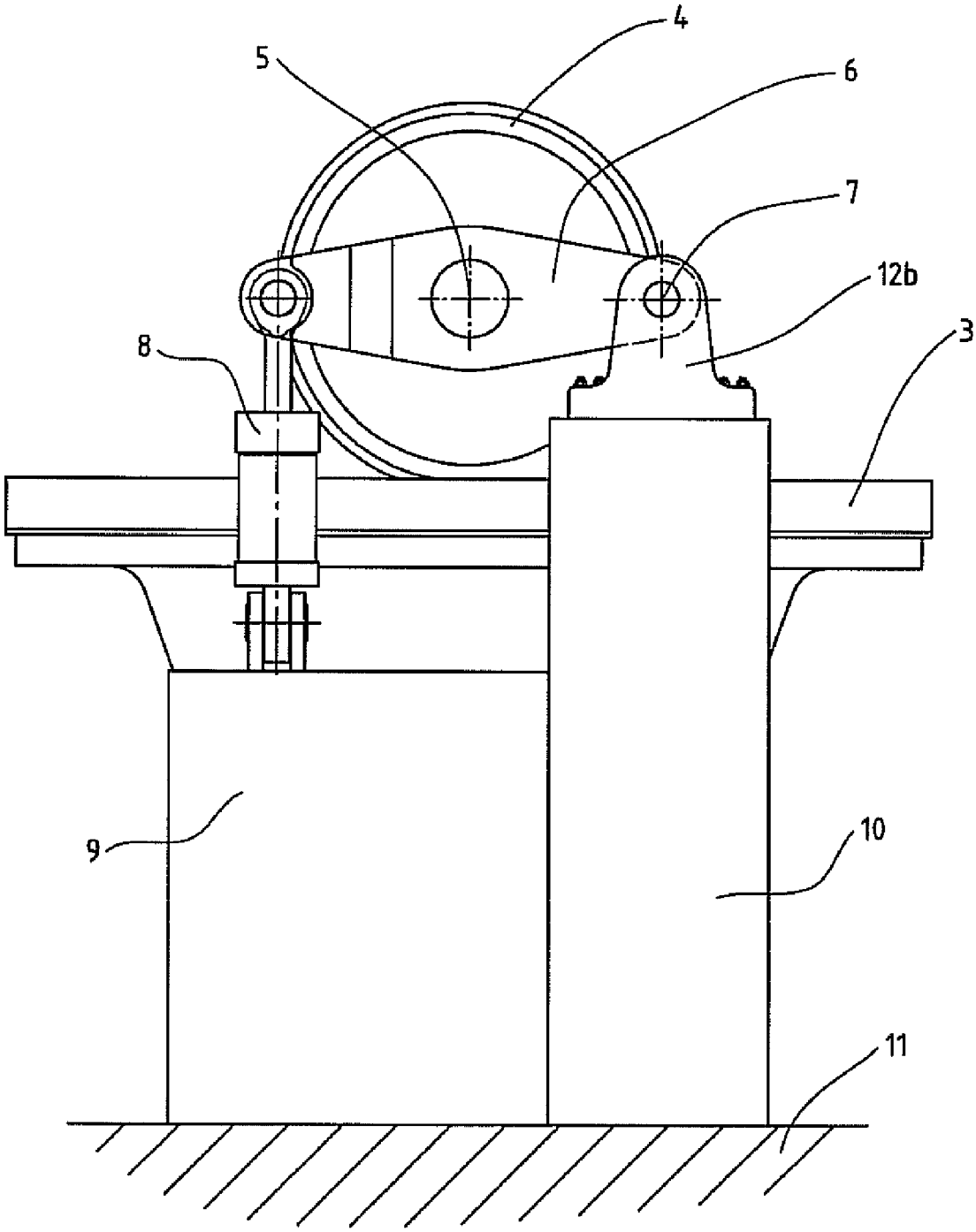

The invention relates to a roller mill having a vertical mill axis.

Different configurations of such mills are well known in practice and from technical literature. Those roller mills or roller grinding mills, which are also referred to as resilient force or external force mills, can be used, for example, to comminute cement raw materials, cement clinker, coal, ore materials and the like. There are provided, within a mill housing, a mill ring or mill platen which is supported so as to be rotatable about the mill axis and which has a mill path constructed thereon and a plurality of mill rollers or mill cylinders which are arranged so as to be distributed over the periphery of the mill path and which roll on that mill path. During comminution operation, the material to be ground which is generally supplied centrally relative to the mill platen or mill ring is comminuted on the mill path between the mill ring and the mill rollers, with pressure members ensuring that a correspondingly large grinding force which is generally adjustable is produced in that region.

In order to achieve this, the mill rollers of those known mill constructions can be guided and positioned against the mill path in various manners. For instance, it is possible, for example, for each mill roller to be supported with its roller shaft on a corresponding pivot lever, by means of which it is pressed mechanically or hydropneumatically by springs resiliently against the grinding material bed which is formed on the mill path. The pivot levers are generally arranged outside the mill housing and have an axis of rotation which is located at right-angles relative to the roller axis. In other known mill constructions, the grinding force is produced by a pressing ring which is under the action of a biased pressure spring system and presses the mill rollers against the mill path or the grinding material bed located thereon.

DE 509 212 further discloses a roller mill having a pivot lever which is for rotatably retaining the mill rollers and which has a pivot axis which is arranged parallel with the mill roller axis. However, those mills have the disadvantage that they cannot bring about the high forces required for efficient grinding for large mills with high throughputs, and the forces cannot readily be changed for different operating conditions. Therefore, an object of the invention is to further develop this type of roller mill so that high forces can also be produced for efficient grinding.

This object is achieved according to the invention by the features of claim 1.

The roller mill according to the invention substantially comprises a mill housing, a mill path which is supported so as to be rotatable about a mill axis inside the mill housing, and at least one mill roller which can be rotated about a mill roller axis and which is engaged with the mill path in terms of rolling action. A pivot lever is further provided in order to rotatably retain the mill roller and has a pivot shaft arranged parallel with the mill roller axis and is supported outside the mill housing. At least one hydropneumatic resilient system, which is in operational contact with the pivot lever, is further provided in order to adjust the pressing pressure of the mill roller.

It is possible to produce, by means of a hydropneumatic resilient system, forces which are substantially greater than in the previously used mechanical resilient systems and which particularly allow efficient grinding in roller mills having high throughputs. In previous roller mills of this construction type, the forces of the pressing system and the arrangement of the pivot lever were dissipated via the mill housing, which can result in higher housing costs and vibration problems for the roller mill if the forces are increased.

Therefore, it is proposed to support the pivot lever with spacing from the mill housing in such a manner that the forces produced by the pressing system are dissipated into the mill foundation directly or via pillars and, in that manner, no reinforcement of the mill housing is necessary. The introduction of the forces into the mill foundation allows good adjustability of the cylinder force by means of the associated storage system.

The subsidiary claims relate to other constructions of the invention.

The hydropneumatic resilient system can have, for example, a traction cylinder having a storage system or a pressure cylinder having a storage system.

According to one embodiment, the hydropneumatic resilient system engages with the pivot lever below the mill roller axis. In another construction, the mill roller is retained at one end of the pivot lever whilst the pressing system moves into operational contact with the pivot lever at the other end and the pivot lever is supported in a central region. The pivot axis of the pivot lever can be arranged upstream or downstream of the mill roller axis in the direction of rotation of the mill path. It is also conceivable to displace the pivot axis of the pivot lever upwards or downwards relative to the mill roller axis.

Figure 1B:
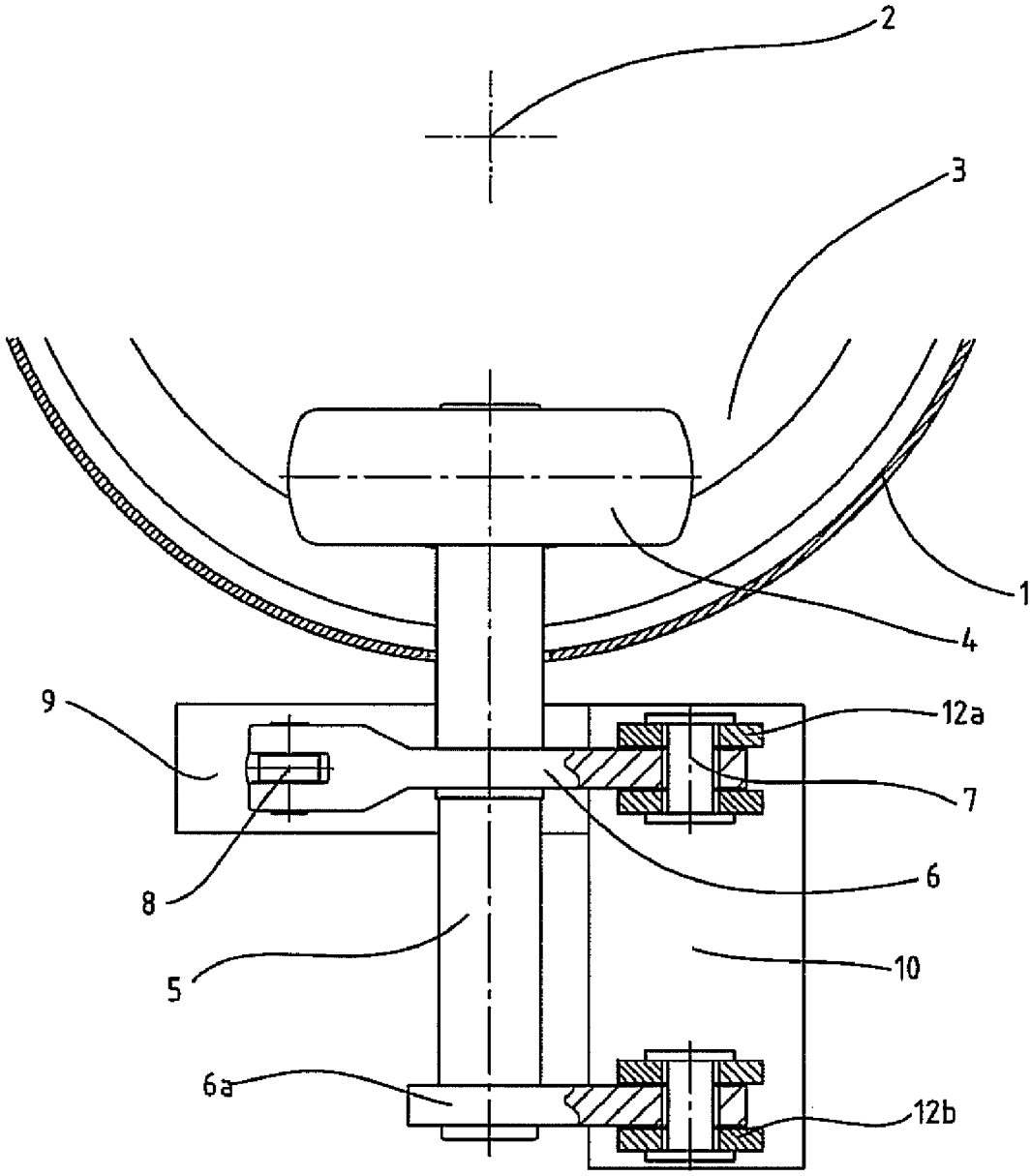
Figure 2A:
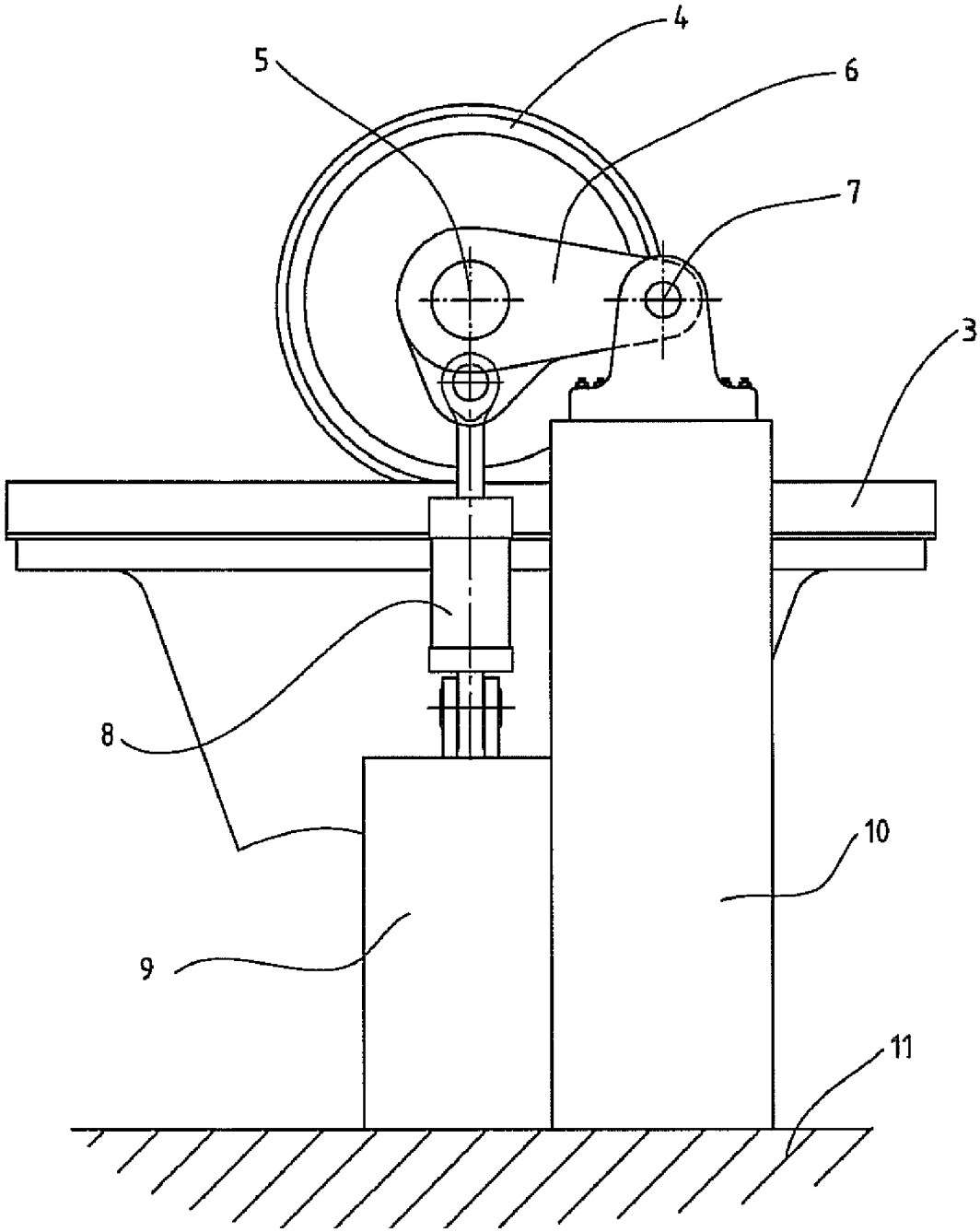
Figure 2B:
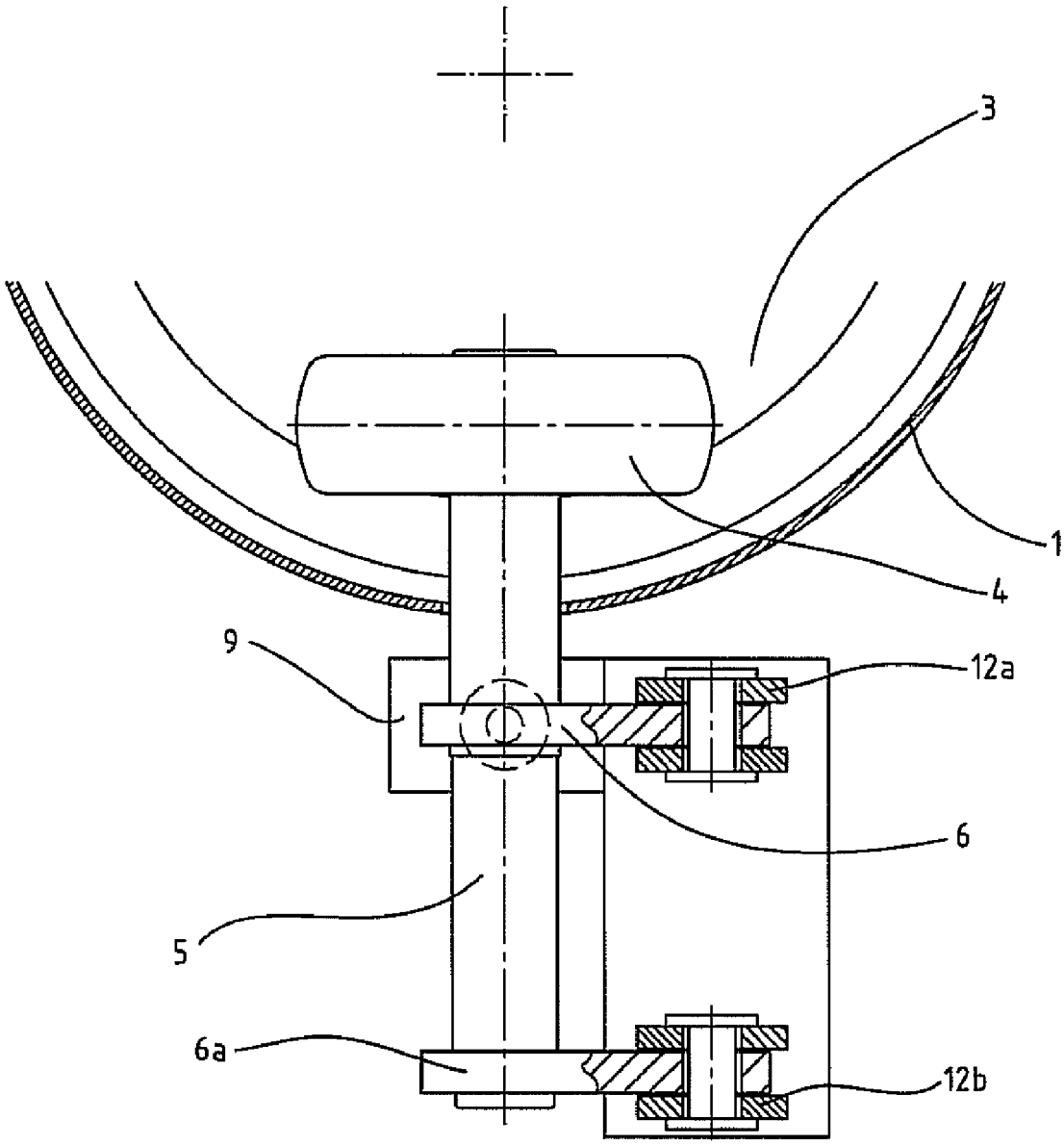
Figure 3A:
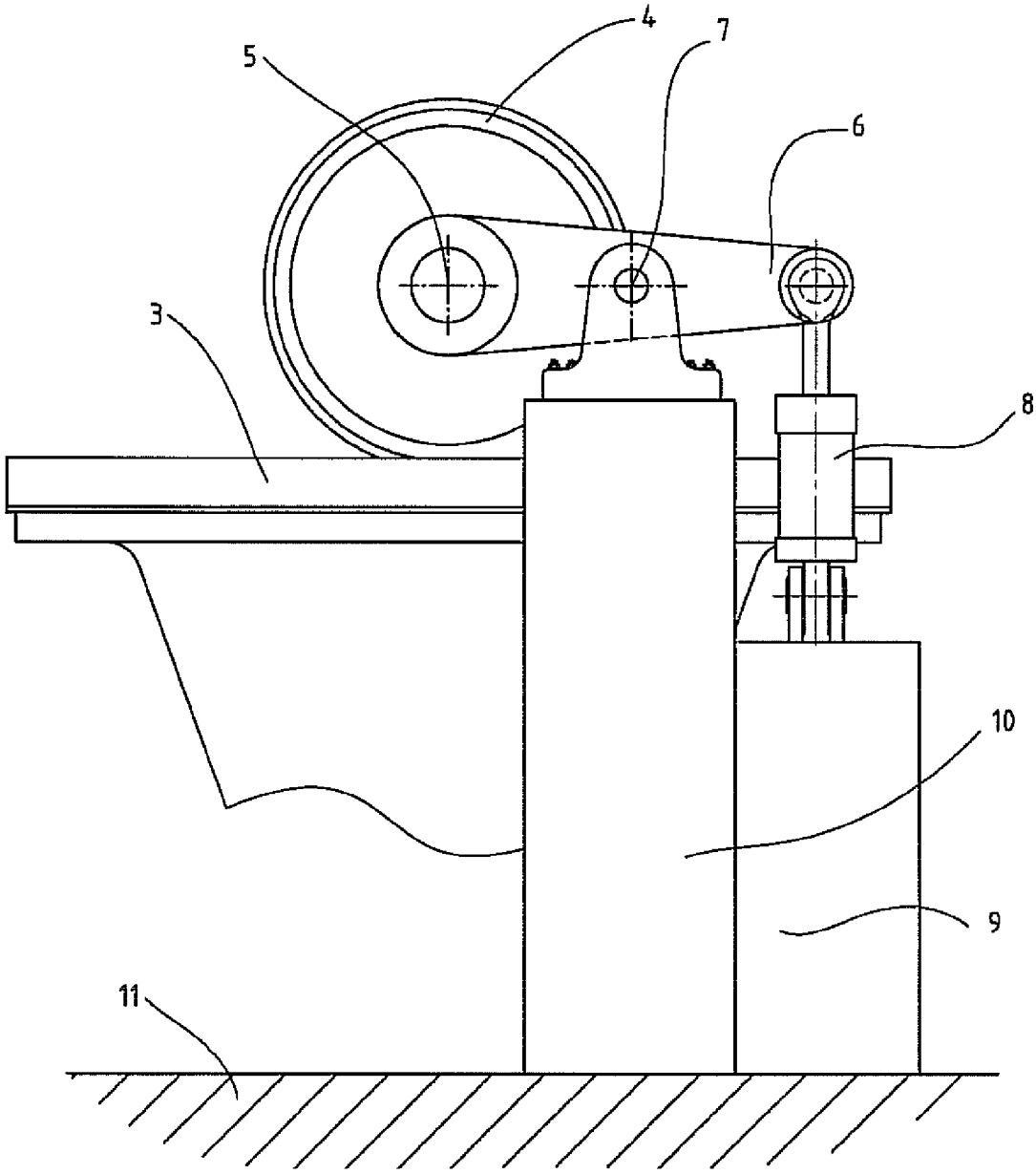
Figure 3B:
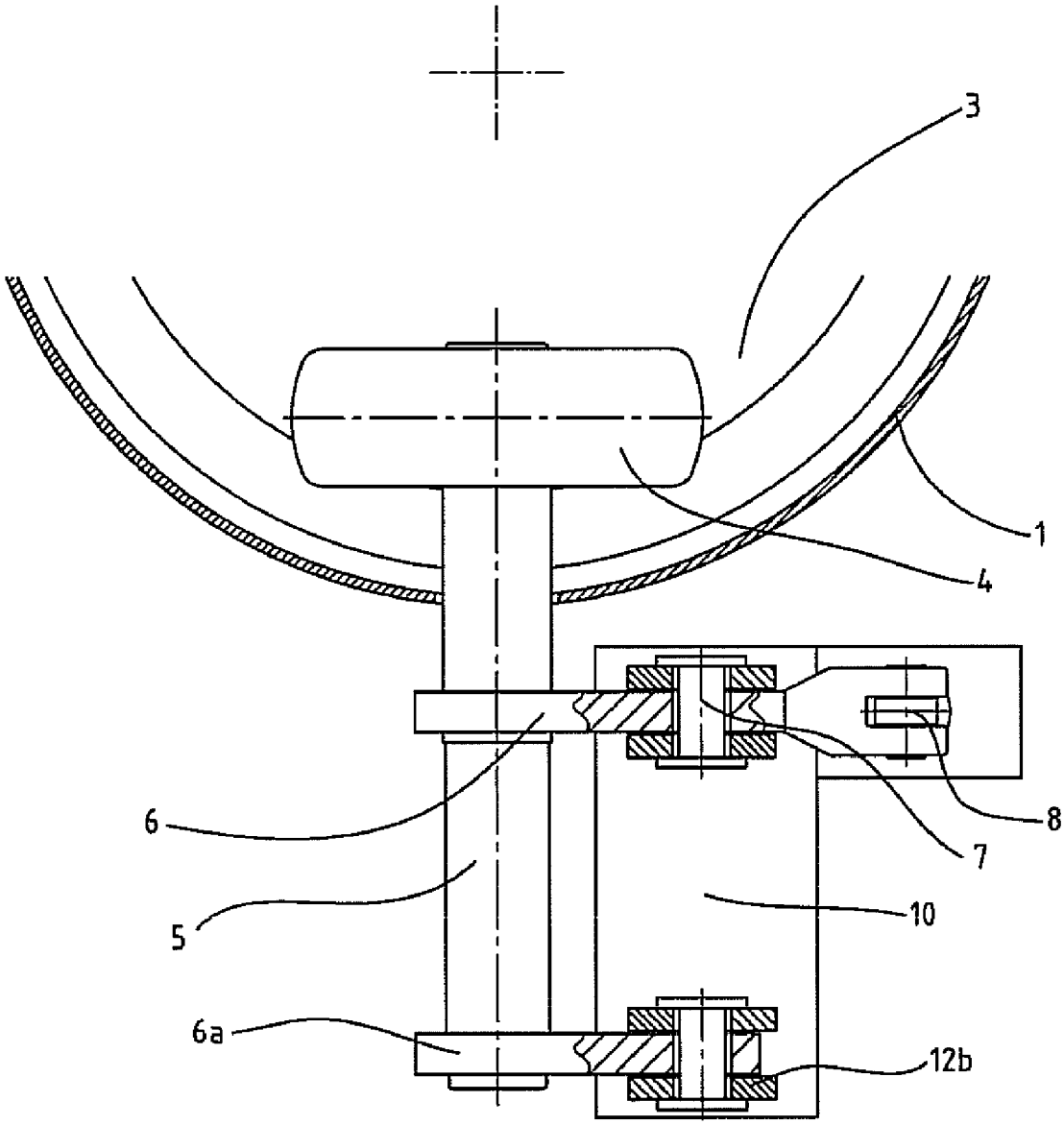
Figure 4A:
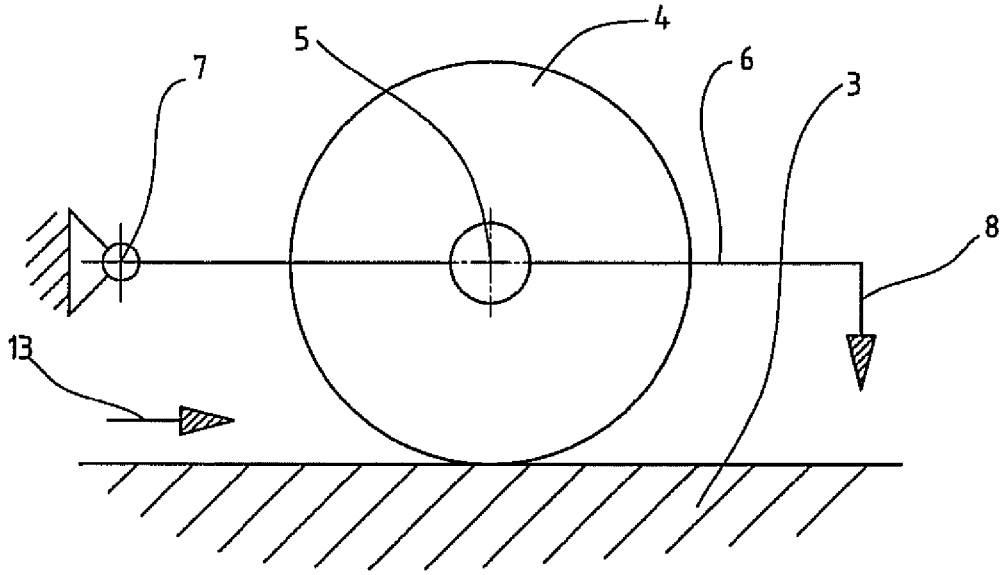
Figure 4B:
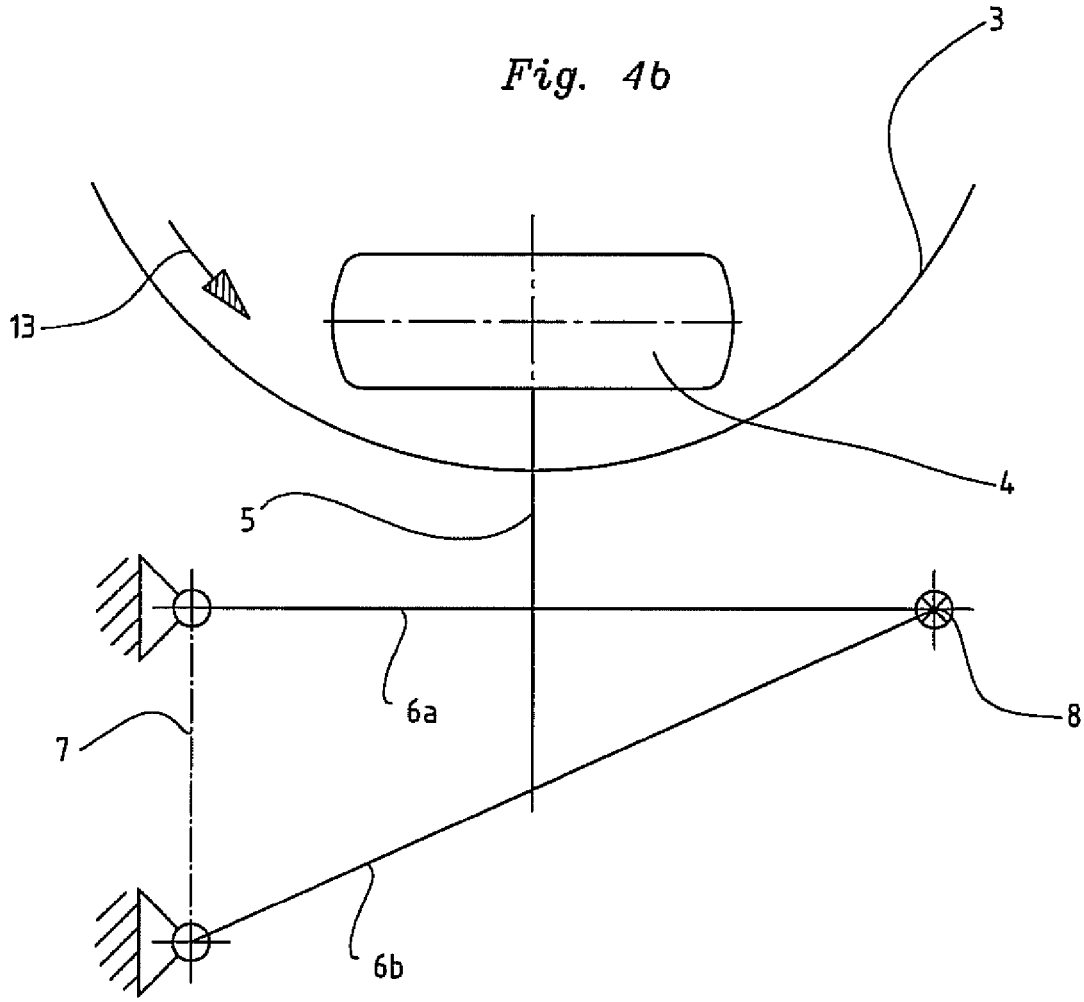
Figure 5A:
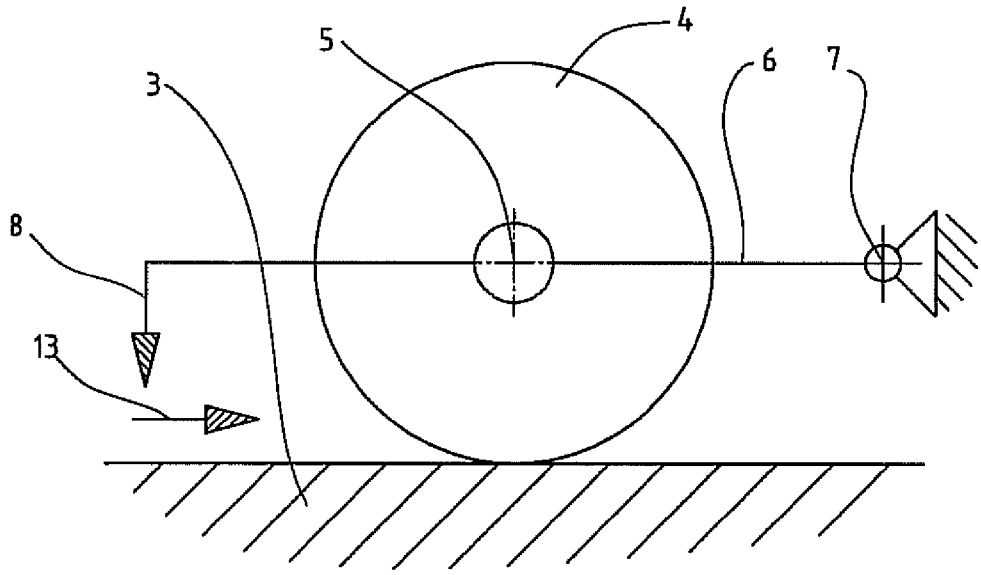
Figure 5B:
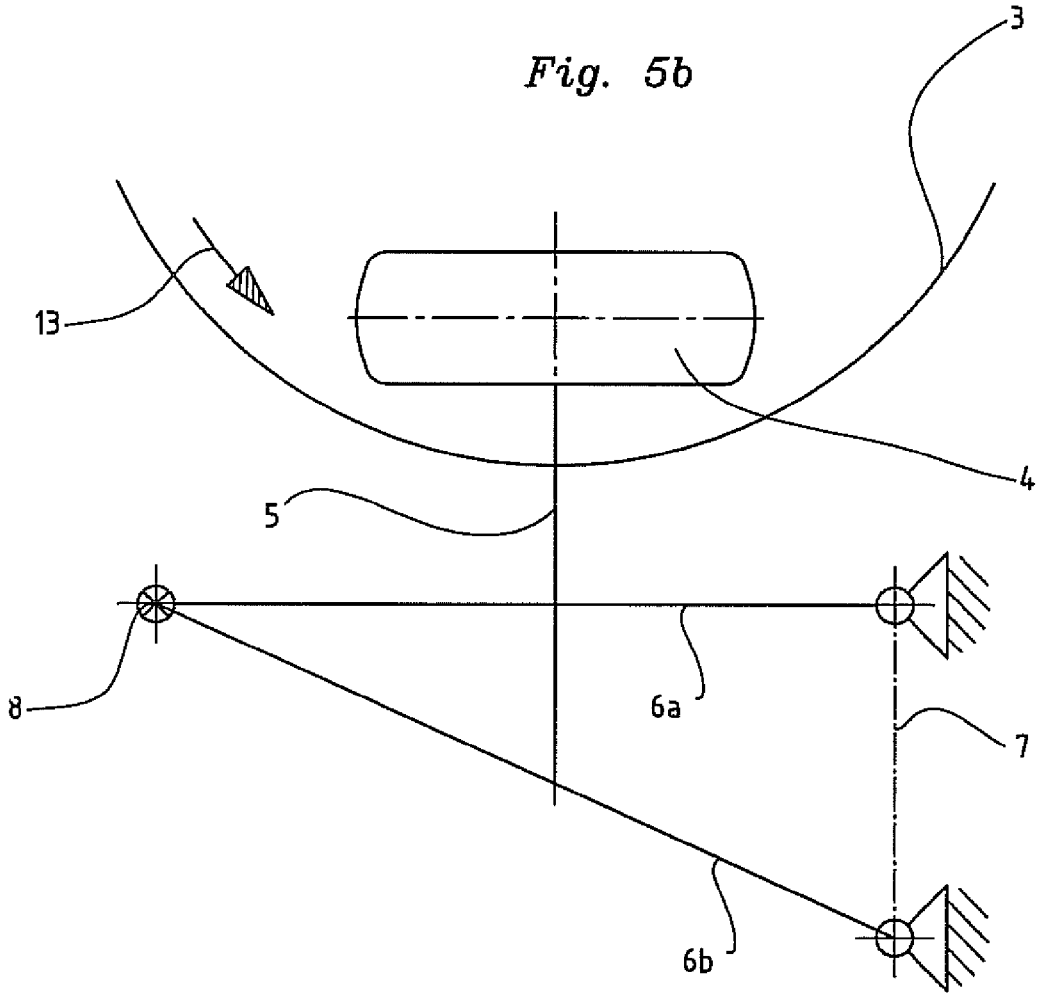
Figure 6A:
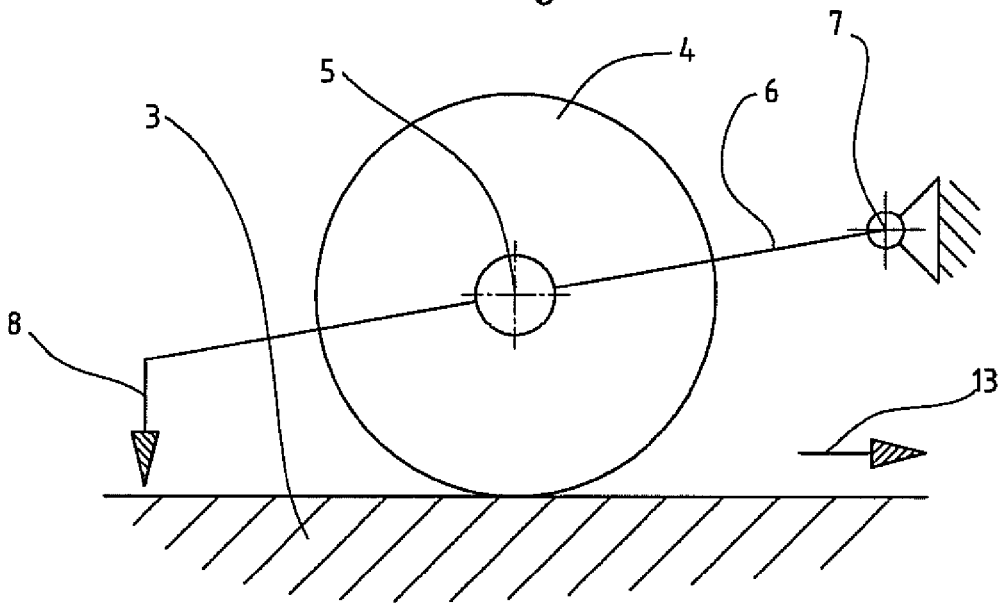
Figure 6B:
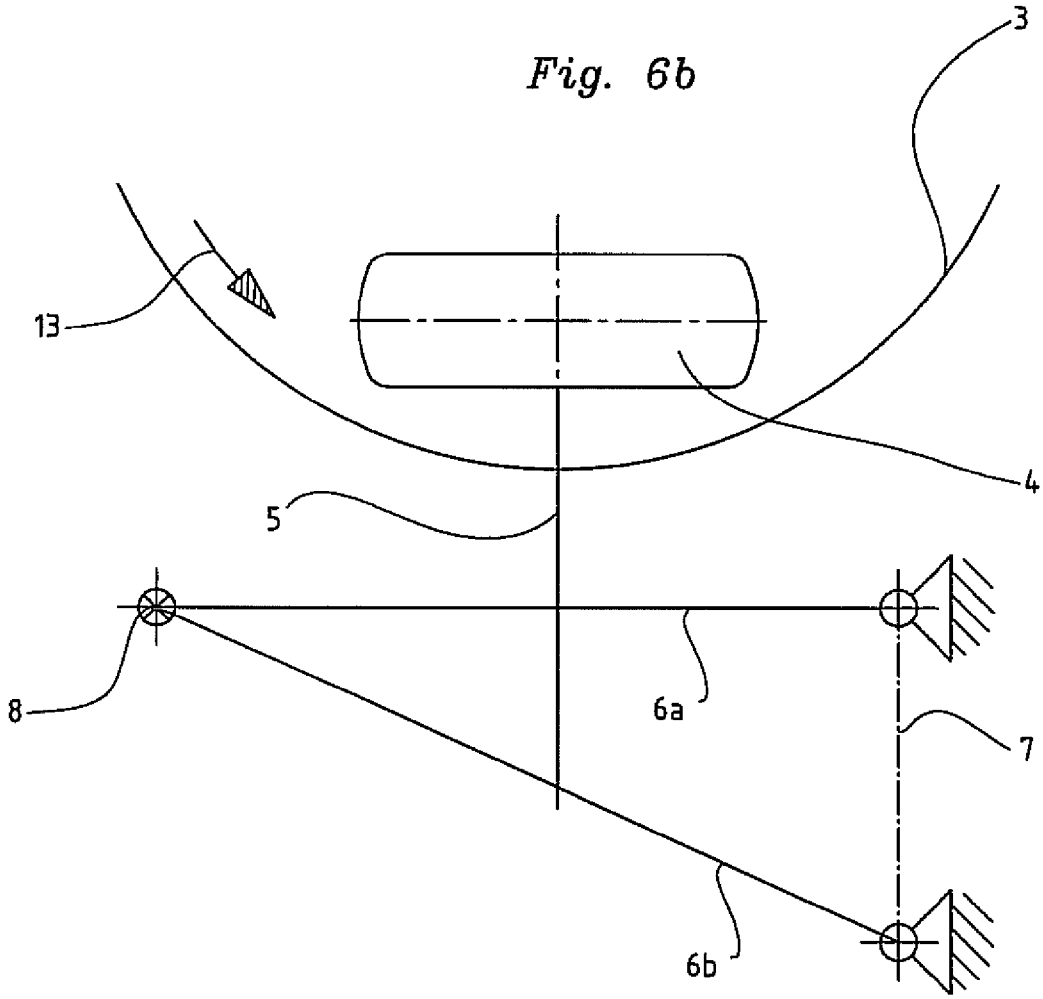
Figure 7A:
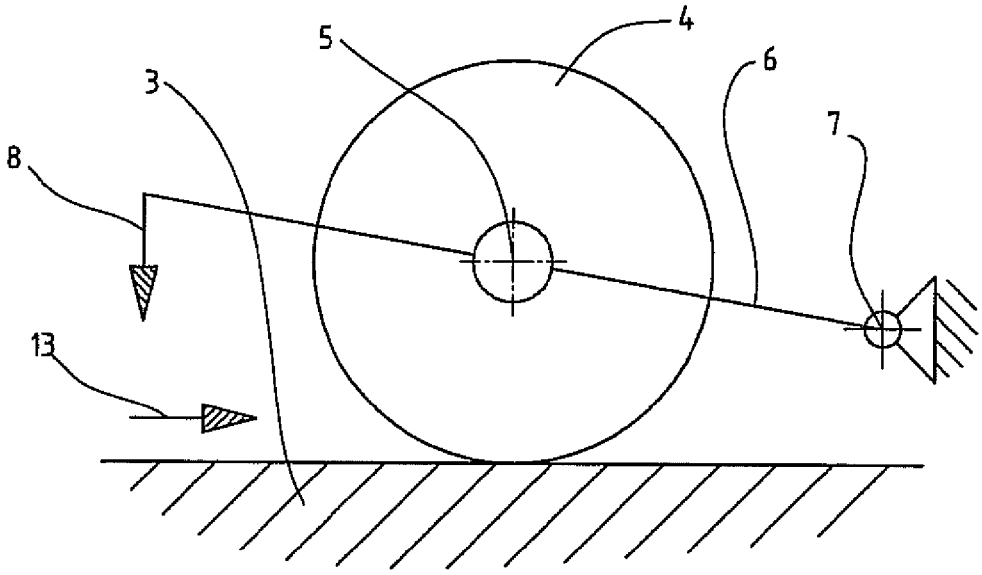
Figure 7B:
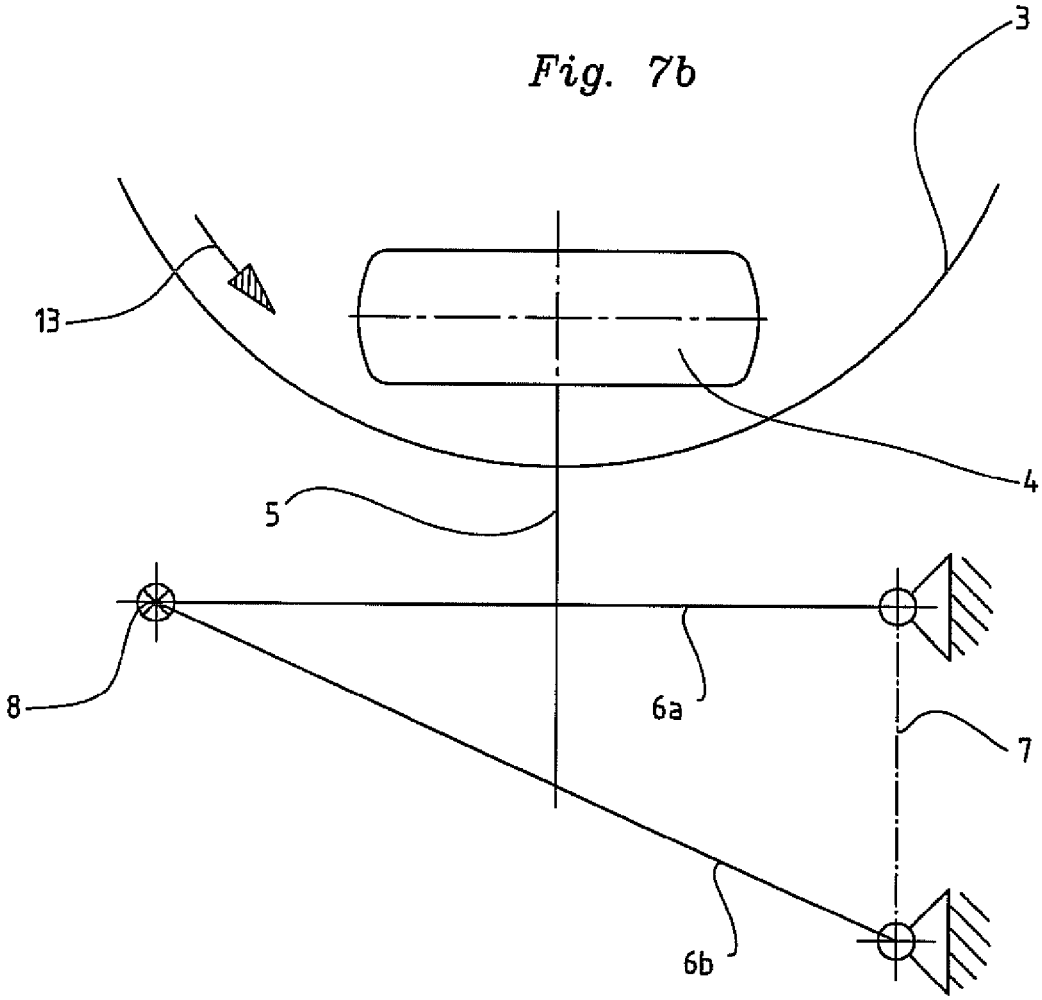
Figure 8:
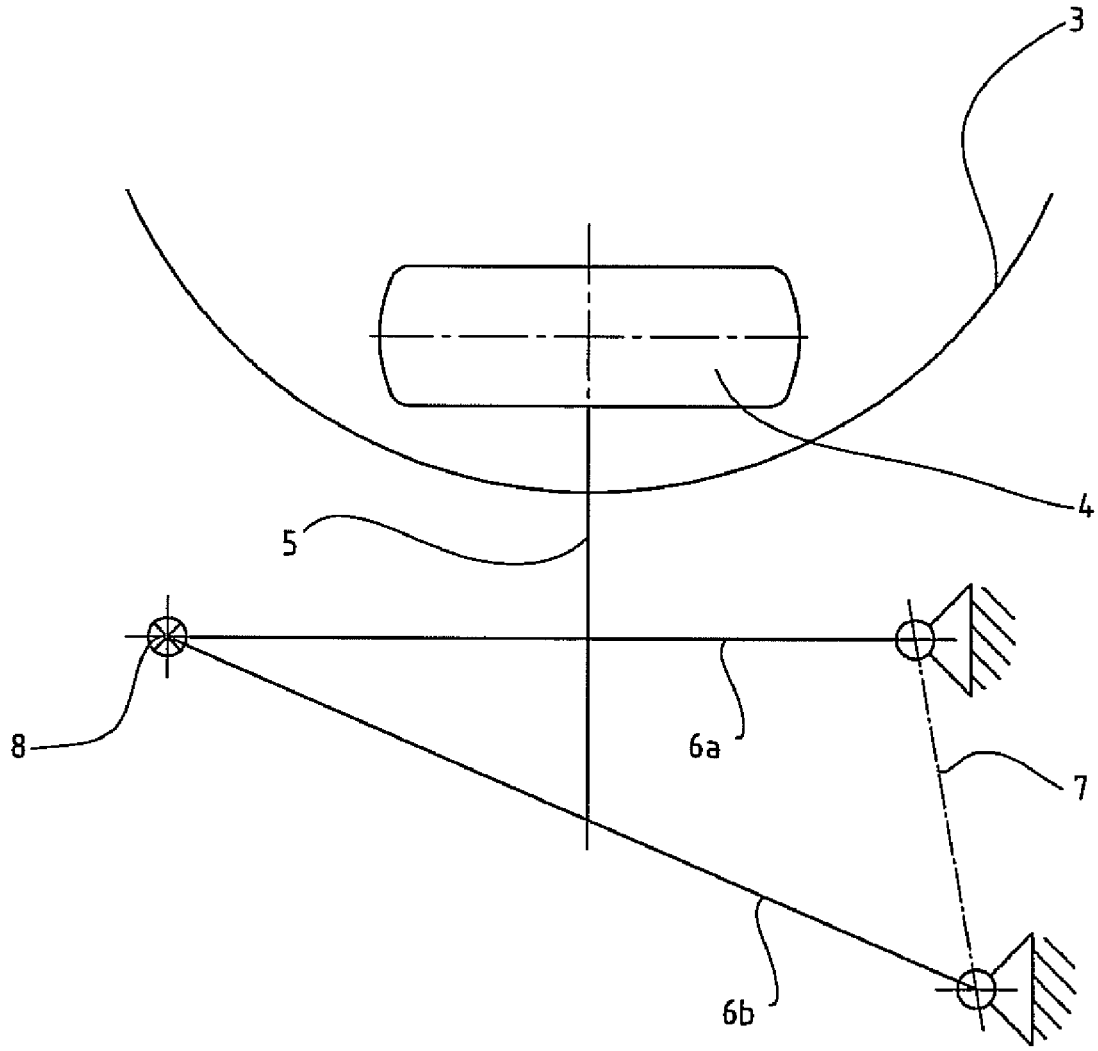
Figure 9:
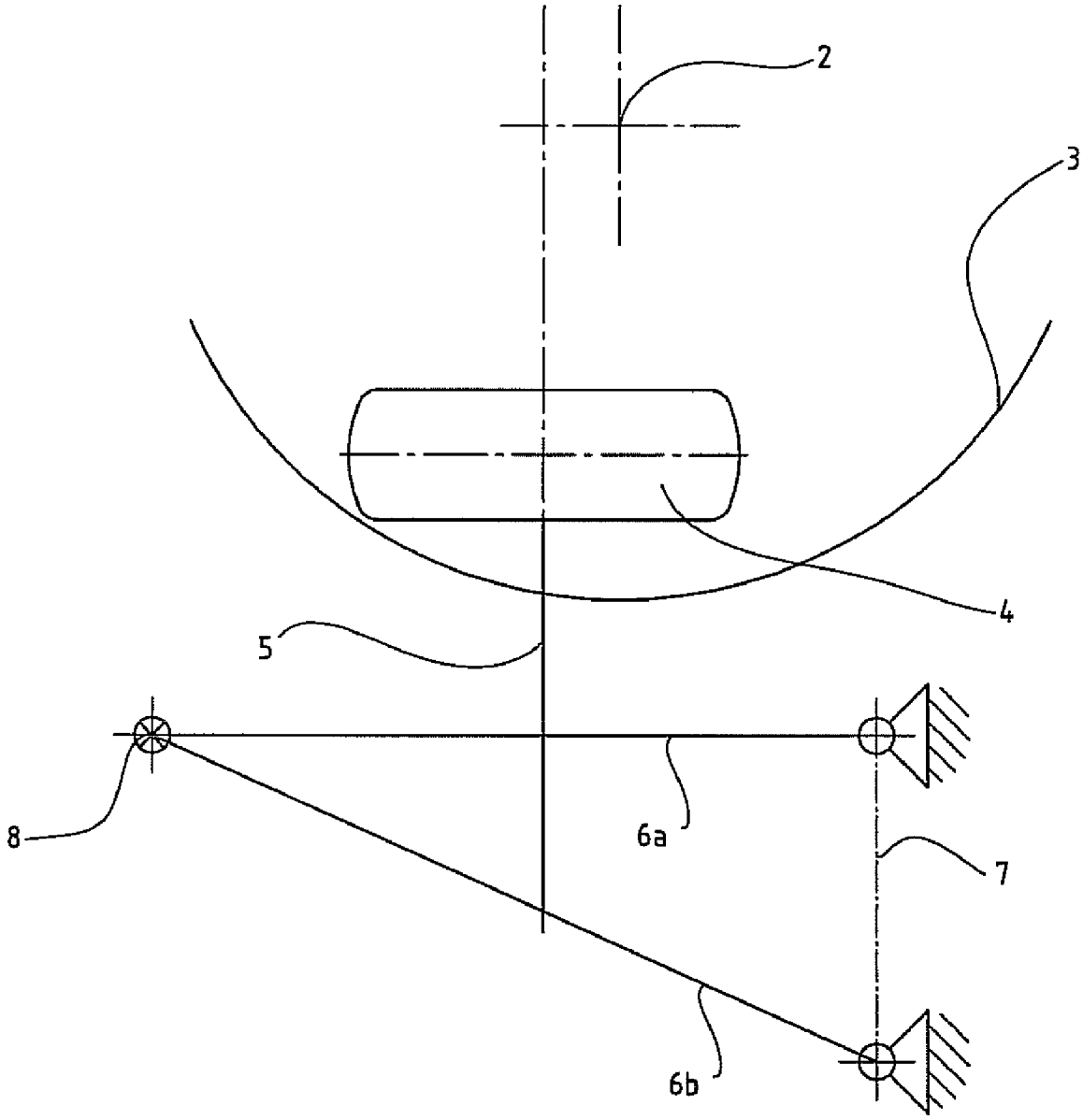
Figure 10:
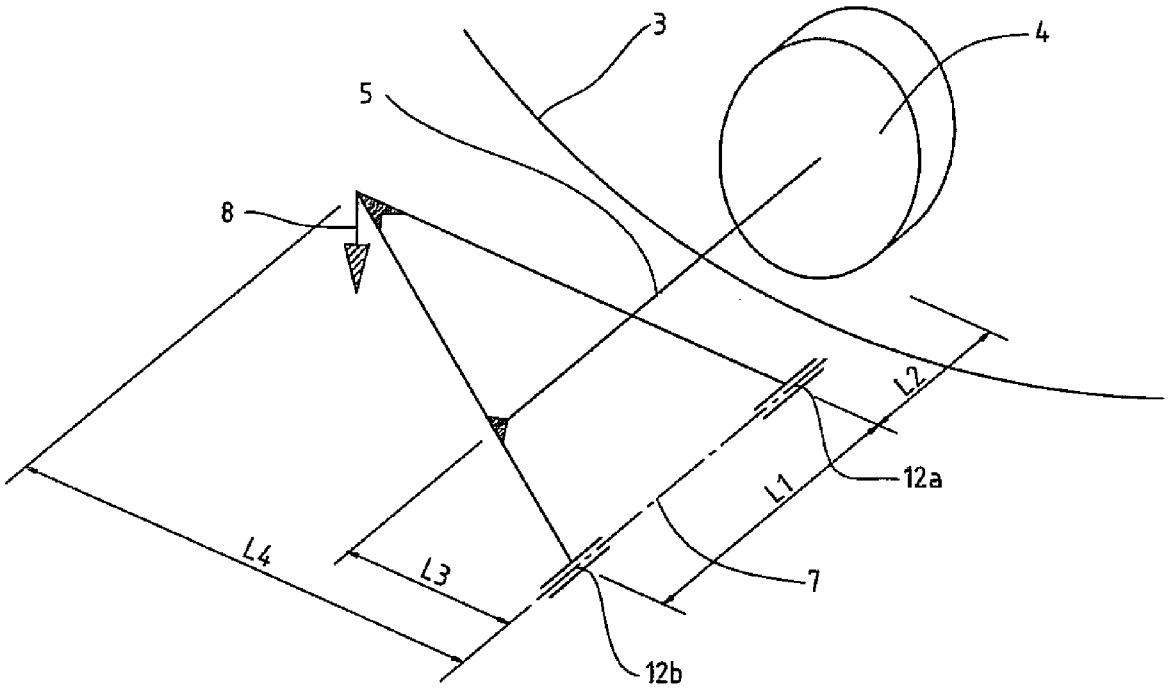

Other advantages and constructions of the invention will be explained in greater detail with reference to the description of a number of embodiments and the drawings, in which:

FIG. 1*a* and FIG. 1*b* are a schematic side view and top view of a roller mill according to a first embodiment, FIG. 2*a* and FIG. 2*b* are a schematic side view and top view of a roller mill according to a second embodiment, FIG. 3*a* and FIG. 3*b* are a schematic side view and top view of a roller mill according to a third embodiment, FIG. 4*a* and FIG. 4*b* are a schematic side view and top view of a roller mill according to a fourth embodiment, FIG. 5*a* and FIG. 5*b* are a schematic side view and top view of a roller mill according to a fifth embodiment, FIG. 6*a* and FIG. 6*b* are a schematic side view and top view of a roller mill according to a sixth embodiment, FIG. 7*a* and FIG. 7*b* are a schematic side view and top view of a roller mill according to a seventh embodiment, FIG. 8 is a schematic top view of a roller mill according to an eighth embodiment, FIG. 9 is a schematic top view of a roller mill according to a ninth embodiment and FIG. 10 is a schematic illustration of the geometry of the pivot lever.

The roller mill illustrated in FIG. 1*a* and FIG. 1*b* substantially comprises a mill housing 1, a mill path 3 which is supported so as to be rotatable about a mill axis 2 within the mill housing and at least one mill roller 4 which can be rotated about a mill roller axis 5 and which is engaged with the mill path 3 in terms of rolling action. There is further provided at least one pivot lever 6 for rotatably retaining the mill roller 4, which lever has a pivot shaft 7 arranged parallel with the mill roller axis 5 and which is supported outside the mill housing 1.

A pressing system for adjusting the pressing pressure of the mill roller 4 is in operational contact with the pivot lever. That pressing system is formed by a hydropneumatic resilient system 8 and the pivot lever 6 is supported with spacing from the mill housing 1 in such a manner that the forces produced by the pressing system are dissipated into the mill foundation 11 directly or via pillars 9, 10.

There are generally provided in the roller mill a plurality of mill rollers, for example, two, four or six mill rollers. Each of the mill rollers would then be provided with an individual pivot lever and associated hydropneumatic resilient system 8. However, it would also be conceivable in the context of the invention for, for example, two rollers to be retained by means of one pivot lever.

In the first embodiment illustrated, the pivot shaft 7 is provided at one end of the pivot lever 6, whereas the hydropneumatic resilient system 8 which has a traction cylinder having a storage system engages with the other end of the pivot lever 6. However, the roller is retained in a central region of the pivot lever 6. The mill roller shaft 5 extends outwards with respect to the mill housing 1, with a suitable seal being provided. The pivot lever bearing is a double pivot lever bearing having two pivot levers 6, 6*a* which have, however, a common pivot axis 7. The hydropneumatic resilient system 8 can optionally engage with both pivot levers but advantageously at least with the pivot lever 6 which is arranged closer to the mill roller 4.

The pivot lever bearing is formed by a first bearing 12*a* and a second bearing 12*b* which is spaced apart. The bearings can optionally be constructed as roller bearings and/or as sliding bearings.

The mill roller 4 can be supported by means of suitable rolling or sliding bearings on the mill roller shaft 5 which does not co-rotate. However, it is also conceivable for the mill roller to be retained in a rotationally secure manner on the mill roller shaft 5 and for the mill roller shaft 5 to be supported rotatably on the pivot lever 6.

Other embodiments are explained with reference to the other Figures, with the same reference numerals being used for identical components.

The roller mill according to the embodiment of FIG. 2*a* and FIG. 2*b* differs from the first embodiment substantially only in that the hydropneumatic resilient system 8 engages with the pivot lever 6 below the mill roller shaft 5. In this instance, the hydropneumatic resilient system is also constructed as a traction cylinder. Direct transmission of force is thereby achieved because only a small lever is provided for the mill roller.

In the embodiment according to FIG. 3*a* and FIG. 3*b*, the mill roller 4 is retained at one end of the pivot lever 6, whereas the hydropneumatic resilient system 8 moves into operational contact with the pivot lever at the other end and the pivot lever 6 is supported in a central region. In that embodiment, the hydropneumatic resilient system 8 is constructed as a pressure cylinder having a storage system. Pressure cylinders are cheaper than traction cylinders owing to the simpler structural shape.

Other embodiments which relate to different variants of the arrangement of the pivot axis 7, mill roller axis 5 and engagement point of the hydropneumatic resilient system 8, are explained below with reference to highly schematic illustrations.

In the embodiment according to FIG. 4*a* and FIG. 4*b*, the pivot axis 7 of the pivot lever is arranged upstream of the mill roller axis 5 in the direction of rotation 13. In the embodiment according to FIG. 5*a* and FIG. 5*b*, the relationships are accordingly transposed so that the pivot axis 7 is arranged downstream of the mill roller axis 5 in the direction of rotation 13 of the mill path 3.

Besides a substantially horizontal arrangement of the pivot lever 6, however, an inclined arrangement may also be envisaged, with the pivot axis 7 being able to be arranged both above the mill roller axis 5 (see FIG. 6*a*, FIG. 6*b*) and below the mill roller axis 5 (see FIG. 7*a*, FIG. 7*b*). The positioning of the pivot lever 6 in accordance with the embodiments 6*a* to 7*b* reduces the bearing forces in the region of the pivot shaft.

Whereas the pivot axis 7 and the mill roller axis 5 are orientated parallel with each other in the previously illustrated embodiments, the pivot axis 7 in the embodiment according to FIG. 8 is (slightly) inclined relative to the mill roller axis 5. In that manner, the kinematics of the mill roller 4 can be improved.

It is further possible to arrange the mill roller axis 5 so as to be displaced relative to the mill axis 3, as illustrated in the embodiment according to FIG. 9. In that manner, it is optionally possible to achieve improved comminution of the material to be ground by means of additional friction.

The pivoting geometry is schematically illustrated in FIG. 10. By the lever relationships and the different distances being changed, it is possible to bring about different force relationships.

During the tests forming the basis of the invention, a range of from 1:0.5 to 1:2, preferably from 1:0.7 to 1:1 was found to be particularly advantageous for the ratio of the distance L2 between the mill roller 4 and the first bearing 12*a* in relation to the distance L1 between the two bearings 12*a*, 12*b*. A suitable range of from 1:0.8 to 1:2, preferably from 1:0.9 to 1:1.2, was further established for the ratio of the distance L3 between the pivot axis 7 and the mill roller axis 5 in relation to the distance L4 between the pivot axis 7 and operational contact of the hydropneumatic resilient system 8.

By using the hydropneumatic resilient system 8, it is possible to achieve maximum mill forces which can readily be dissipated into the mill foundation 11 directly or via pillars 9, 10. The pivot lever 6 allows parallel movement of the mill roller 4 relative to the mill path 3 and therefore does not result in any changed geometry relationships in the event of wear of the mill rollers; it is further possible, with this arrangement and selection of suitable lever relationships, to introduce a force which is smaller than or equal to the force which is produced at the mill roller. Owing to suitable geometry relationships, the forces at the two bearings 12*a*, 12*b* can even be smaller than the forces at the mill roller. This type of mill roller bearing further makes it possible for the tangential force which is produced from the grinding operation to increase the vertical force at the mill roller.

The invention claimed is:

1. Roller mill having a mill housing (1), a mill path which is supported so as to be rotatable about a mill axis (2) inside the mill housing, at least one mill roller (4) which can be rotated about a mill roller axis (5) and which is engaged with the mill path in terms of rolling action, at least one pivot lever (6) which is for rotatably retaining the mill roller (4) and which has a pivot shaft (7) arranged parallel with the mill roller axis (5) and which is supported outside the mill housing, and having at least one pressing system which is in operational contact with the pivot lever in order to adjust the pressing pressure of the mill roller (4), wherein the pressing system is formed by a hydropneumatic resilient system (8) and the pivot lever (6) is supported with spacing from the mill housing (1) in such a manner that the forces which are produced by the pressing system are dissipated into a mill foundation directly or via pillars, wherein the bearing of the pivot lever (6) has a first bearing (12*a*) and a second spaced-apart bearing (12*b*) having a common pivot axis (7) and the ratio of the distance (L2) between the mill roller (4) and the first bearing (12*a*) relative to the distance (L1) between the two bearings (12*a*, 12*b*) is from 1:0.5 to 1:2.

2. Roller mill according to claim 1, characterised in that the hydropneumatic resilient system (8) has at least one traction cylinder having a storage system.

3. Roller mill according to claim 1, characterised in that the hydropneumatic resilient system (8) engages with the pivot lever (6) below the mill roller axis.

4. Roller mill according to claim 1, characterised in that the hydropneumatic resilient system (8) has at least one pressure cylinder having a storage system.

5. Roller mill according to claim 1, characterised in that the mill roller (4) is retained at one end of the pivot lever (6) whilst the hydropneumatic resilient system (8) moves into operational contact with the pivot lever (6) at the other end and the pivot lever is supported in a central region.

6. Roller mill according to claim 1, characterised in that the pivot axis (7) of the pivot lever (6) is arranged upstream of the mill roller axis (5) in the direction of rotation (13) of the mill path (3).

7. Roller mill according to claim 1, characterised in that the pivot axis (7) of the pivot lever (6) is arranged downstream of the mill roller axis (5) in the direction of rotation (13) of the mill path (3).

8. Roller mill according to claim 1, characterised in that the pivot axis (7) of the pivot lever (6) is arranged so as to be displaced upwards relative to the mill roller axis (5).

9. Roller mill according to claim 1, characterised in that the pivot axis (7) of the pivot lever (6) is arranged so as to be displaced downwards relative to the mill roller axis (5).

10. Roller mill according to claim 1, characterised in that the pivot axis (7) of the pivot lever (6) is arranged so as to be inclined relative to the mill roller axis (5).

11. Roller mill according to claim 1, characterised in that the mill roller axis (5) is arranged so as to be displaced relative to the mill axis (2).

12. Roller mill according to claim 1, characterised in that the bearing (12) of the pivot lever (6) has roller bearings.

13. Roller mill according to claim 1, characterised in that the bearing of the pivot lever (6) has sliding bearings.

14. Roller mill according to claim 1, characterised in that the ratio of the distance (L3) between the pivot axis (7) and the mill roller axis (5) relative to the distance (L4) between the pivot axis (7) and operational contact of the hydropneumatic resilient system (8) is from 1:0.8 to 1:2, preferably from 1:0.9 to 1:1.2.

* * * * *

UNITED STATES PATENT AND TRADEMARK OFFICE

CERTIFICATE OF CORRECTION

PATENT NO. : 8,038,084 B2
APPLICATION NO. : 12/528479
DATED : October 18, 2011
INVENTOR(S) : Dirk Dilly et al.

It is certified that error appears in the above-identified patent and that said Letters Patent is hereby corrected as shown below:

Title page, PCT Filed: "Feb. 25, 2009" should read --Feb. 25, 2008--.

Signed and Sealed this
Thirty-first Day of January, 2012

David J. Kappos

David J. Kappos
*Director of the United States Patent and Trademark Office*